United States Patent [19]

Bergin et al.

[11] Patent Number: 4,569,005

[45] Date of Patent: Feb. 4, 1986

[54] REPLACEABLE LAMP UNIT AND AUTOMOBILE HEADLIGHT UTILIZING SAME

[75] Inventors: John A. Bergin, Hancock, N.H.; Bernard J. Warren, Dover-Foxcroft, Me.

[73] Assignee: GTE Products Corporation, Stamford, Conn.

[21] Appl. No.: 691,804

[22] Filed: Jan. 15, 1985

[51] Int. Cl.[4] ..... F21V 19/00

[52] U.S. Cl. ..... 362/267; 362/307; 362/375; 313/113; 313/318

[58] Field of Search ..... 362/211, 267, 226, 296, 362/300, 307, 310, 375; 313/113, 115, 316, 318, 579

[56] References Cited

U.S. PATENT DOCUMENTS

| | | | |
|---|---|---|---|
| 413,708 | 10/1889 | Goad | 362/158 |
| 1,713,335 | 5/1929 | Green | 362/267 |
| 2,423,664 | 7/1947 | Ryder | 362/307 |
| 2,750,491 | 6/1956 | Anderson | 362/267 |
| 3,157,449 | 11/1964 | Hennessey | 339/66 R |
| 3,593,017 | 7/1971 | Cibie | 362/267 |
| 3,688,103 | 8/1972 | Daumuller | 362/267 |
| 3,829,729 | 8/1974 | Westlund et al. | 313/174 |
| 3,885,149 | 4/1973 | Wolfe et al. | 313/318 |
| 3,917,939 | 11/1975 | Schmidt et al. | 313/113 |
| 3,960,278 | 6/1976 | Vause | 313/318 |
| 3,987,326 | 10/1976 | Lindae | 313/113 |
| 4,019,045 | 4/1977 | Bassett | 339/127 R |
| 4,287,448 | 9/1981 | Bradley | 313/113 |
| 4,336,578 | 6/1982 | Bradley et al. | 362/267 |
| 4,342,142 | 8/1982 | Nieda et al. | 29/25.13 |
| 4,344,119 | 8/1982 | Bergot | 362/267 |
| 4,412,273 | 10/1983 | Helbig et al. | 362/211 |
| 4,470,104 | 9/1984 | Cox | 362/211 |
| 4,473,770 | 9/1984 | Baba et al. | 362/267 |
| 4,528,619 | 7/1985 | Dolan et al. | 362/267 |

FOREIGN PATENT DOCUMENTS

| | | |
|---|---|---|
| 605054 | 9/1960 | Canada . |
| 2449626 | 4/1976 | Fed. Rep. of Germany . |
| 2732404 | 1/1978 | Fed. Rep. of Germany . |
| 106636 | 2/1943 | Sweden . |

*Primary Examiner*—William A. Cuchlinski, Jr.
*Attorney, Agent, or Firm*—Lawrence R. Fraley

[57] ABSTRACT

A lamp unit (10) for being removably positioned within the rear opening (11) of an automobile headlight reflector (13). The unit (10) includes a plastic holder (19), an electric (e.g., tungsten halogen) lamp (30) having a filament structure (42) contained within the envelope (33) thereof, a clamp member (46) secured to the lamp's press-sealed end portion (47), and an insert member (48) located within a cavity (21) of the holder (19). The clamp member (46) includes a pair of curved flange portions (56,58) which engage and are secured (e.g., welded) to the outer, curved surface (59) of the insert member (48), thus facilitating alignment and positioning of the lamp (30) relative to the holder (19).

16 Claims, 3 Drawing Figures

REPLACEABLE LAMP UNIT AND AUTOMOBILE HEADLIGHT UTILIZING SAME

TECHNICAL FIELD

The invention relates to automobile headlights and more particularly to those wherein a replaceable lamp unit assembly is utilized.

BACKGROUND

Automobile headlights wherein a replaceable lamp unit is employed are well known in the art. Examples are illustrated in the below-identified U.S. Pat. Nos.:

2,423,664, E. Ryder
2,750,491, H. J. Anderson
3,593,017, P. Cibie
3,688,103, H. Daumuller
3,917,939, H. J. Schmidt et al.
3,987,326, G. Lindae
4,342,142, Y. Neida et al.
4,344,119, T. Bergot
4,412,273, P. Helbig et al.

As stated, the instant invention is related to lamps of the variety described above. In particular, the invention defines a replaceable lamp unit which provides both a hermetic seal for the unit within the headlight's reflector and, equally important, assures that the electric lamp utilized therewith will be maintained in strict alignment as is necessary in automotive headlights. By the term hermetic seal is meant a seal which prevents the passage of moisture, dust and other elements which can adversely affect the operation of the headlight. By way of example, excessive moisture entering the headlight can adversely affect the reflective coating typically utilized on the concave reflector of the headlight, and thus significantly reduce light output.

In addition to providing a hermetic seal, the replaceable lamp unit defined herein assures that alignment of the electric lamp employed therewith will be maintained. That is, alignment of the glass envelope of the lamp relative to the unit's holder is provided such that the filament structure within the envelope (either a singular coiled filament or two, spaced coiled filaments) will be accurately aligned relative to the optical axis of the reflector when the lamp unit is oriented within the reflector's rear opening. Such alignment is deemed critical to assure optimum headlight output in the direction(s) desired.

As also described herein, a preferred light source which constitutes an important part of the replaceable lamp unit defined herein is an electric lamp of the tungsten halogen variety. One example is shown in U.S. Pat. No. 3,829,719 (Westlund, Jr. et al.), said patent assigned to the same assignee as the instant invention. In tungsten halogen lamps, the tungsten which constitutes the filament material is normally evaporated from the filament during lamp operation and combines with the halogen to form a gaseous halide, the halide preventing the tungsten from depositing on the internal wall of the lamp's glass envelope. Upon returning to the filament structure, the halide decomposes, resulting in the deposition of tungsten back onto the filament structure and the release of additional halogen gas to assure continuation of the cycle. The halogen cycle is well known in the art and lamps employing it have been used for some time. In the case of the two beam (dual filament) lamp, a typical tungsten halogen lamp provides about 65 watts when operated at high beam and about 35 watts at low beam. As stated, it is critical that the filament structure of the lamp within an automobile headlight be aligned relative to the reflector to provide optimum output of the finished headlight. As will be described below, such alignment constitutes an important feature of the replaceable lamp unit defined herein.

DISCLOSURE OF THE INVENTION

It is an object of the instant invention to enhance the automobile headlight art and, more particularly, to enhance that portion of the art wherein replaceable units that employ electric lamps are utilized.

It is another object of the invention to provide a replaceable lamp unit for use within an automobile headlight which provides a hermetic seal for the electric lamp positioned therein and also maintains the lamp in a fixed, precisioned relationship relative to the holder thereof such that the lamp is precisely oriented relative to the headlight's reflector when the unit is located therein.

It is another object of the invention to provide such a replaceable lamp unit which can be inexpensively produced in a manner readily adapted to mass production.

In accordance with one aspect of the invention, there is defined an improved lamp unit capable of being removably positioned within the rear opening of a reflector which constitutes part of an automobile headlight. The lamp unit is designed for being electrically connected to an external connector which forms part of the electrical circuitry of the automobile. The lamp unit includes an electrically insulative holder defining a cavity therein and an electric lamp positioned within the holder and which includes an envelope having a filament structure therein for being oriented within the reflector when the holder is located within the reflector's rear opening. The lamp unit also includes at least two electrically conductive lead-in wires projecting from the envelope. The improvement comprises a clamp member which is secured about the envelope at a precise location relative to the filament structure and an insert member located at a precise depth within the holder's cavity. The clamp member is aligned on a surface of the insert and secured (e.g., welded) thereto such that the filament structure will be precisely oriental relative to said reflector.

In accordance with another aspect of the invention, there is defined an improved automobile headlight which includes a concave reflector (glass or plastic) including a rear opening therein, a front lens for directing light emitted from the electric lamp of the headlight and reflected by the reflector, and a lamp unit adapted for being removably positioned within the concave reflector's rear opening. The lamp unit includes an insulative holder for being positioned within the rear opening and defines a cavity therein. The headlight further includes an electric lamp positioned within the holder and including an envelope and at least two electrically conductive lead-in wires projecting from the envelope.

The improvement comprises a clamp member which is secured about the envelope at a precise location relative to the filament structure and an insert member located at a precise depth within the holder's cavity. The clamp member is aligned on a surface of the insert and secured (e.g., welded) thereto such that the filament structure will be precisely oriented relative to the reflector.

BEST MODE FOR CARRYING OUT THE INVENTION

For a better understanding of the present invention, together with other and further objects, advantages and capabilities thereof, reference is made to the following disclosure and appended claims in connection with the above-described drawing.

Figure 1:
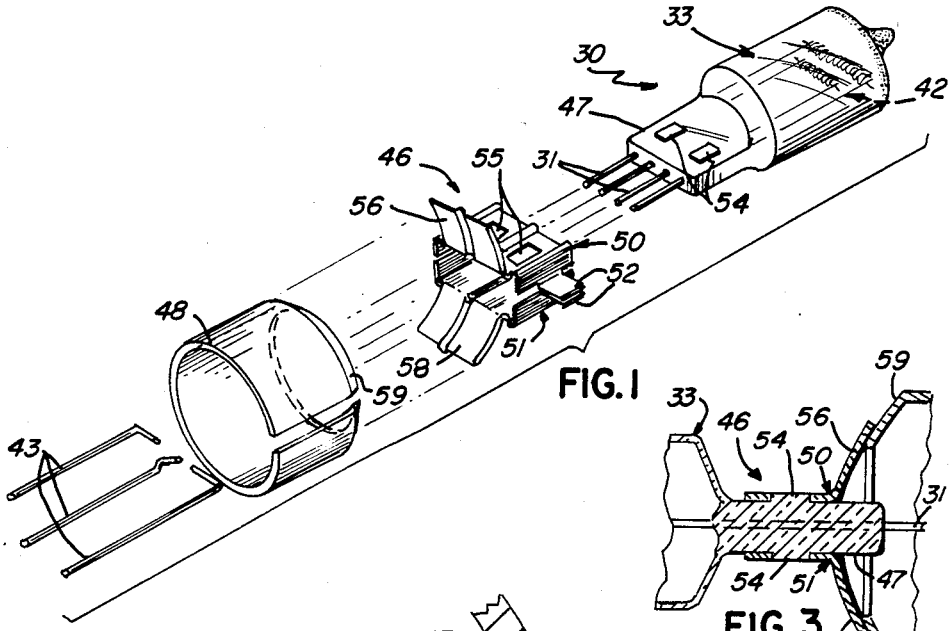
FIG. 1 represents an exploded perspective view of the electric lamp, clamp member, insert member, and support wires of a lamp unit in accordance with a preferred embodiment of the invention.

With particular attention to FIG. 1, there is illustrated in a perspective view several components which form part of a lamp unit 10 (FIG. 2) capable of being removably positioned within the rear opening 11 of a reflector 13 which forms part of an automobile headlight. Lamp unit 10 is further designed for being electrically connected to an external connector (not shown) which comprises part of the electrical circuitry of the automobile using the headlight. Specifically, this external connector is designed for being inserted within the rear portion 15 of unit 10 after unit 10 has been positioned within the reflector's opening. Such a connector typically includes a plurality of electrical wires which also form part of the automobile's circuit. These wires are thus either directly or indirectly connected to the power source (e.g., 6- or 12-volt battery) typically found in most automobiles.

Unit 10 includes an electrically insulative holder 19 which defines therein a first cavity 21 and a second cavity 23, said cavities separated by a common wall member 25. Holder 19 is comprised of a heat and impact resistant plastic (e.g., polyphenylene sulfide) and is thus readily suited for use within the relatively harsh environments typically found about automobile headlights.

Figure 2:
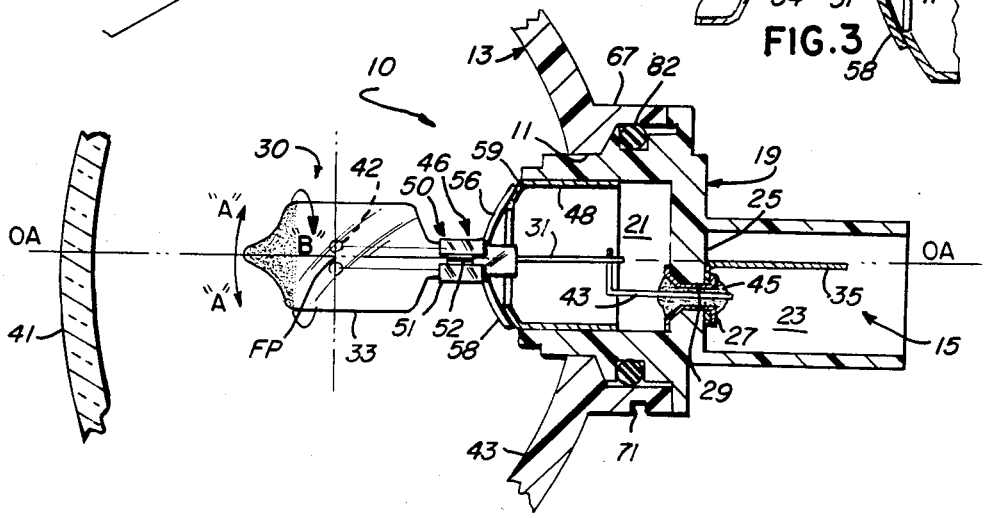
FIG. 2 is a side elevational view, in section, of the lamp unit of the invention and further illustrating the reflector and lens members of a preferred embodiment of an automobile headlight of the invention.

Unit 10 preferably further includes at least two (only one being shown) electrically conductive members 27 which are each fixedly secured within a respective one of a similar number of apertures 29 (one shown in FIG. 2) located within wall member 25. It is understood that a minimum of two apertures and corresponding electrically conductive members 27 are to be utilized in the instant invention. In the embodiment depicted herein, three members 27 (and apertures 29) are utilized because holder 19 accommodates a dual filament, tungsten halogen lamp 30. Typically, tungsten halogen lamps which include a dual coil filament structure 42 therein (such as shown in FIGS. 1 and 2) in turn include at least four lead-in wires 31 (only one being shown in FIG. 2) which project externally from the glass envelope 33 of the lamp. In the case of a single coil tungsten filament lamp, only two lead-in wires are typically utilized. It is thus understood with regard to the invention, that holders 19 is adapted for accommodating both single and double coil filament tungsten halogen lamps.

Each of the electrically conductive members 27 is preferably in the form of a conical shaped metal eyelet. A preferred material for each eyelet is tin-plated brass. Other suitable metals include aluminum, copper, steel, and nickel-iron alloy.

Electrically connected to each eyelet is a metallic lug member 35 which includes a base segment positioned firmly against wall 25 and an upstanding leg segment which extends within second cavity 23. Accordingly, each of the lug members 35 (understandably, a total of three are used in the embodiment shown in the drawing) is designed for being inserted within a corresponding opening of the aforementioned external connector to provide electrical connection therewith when the connector is inserted within cavity 23.

As stated, holder 19 is adapted for accommodating an electric lamp 30 which is preferably of the tungsten halogen variety. When in final position within opening 11 of reflector 13, the envelope 33 of lamp 30 extends within the reflector and is substantially surrounded by the reflecting surfaces 43 thereof in such a manner so as to provide optimum light output from the headlight. The headlight further includes the forward lens member 41 secured to reflector 13 and designed for directing light in a predetermined pattern from the assembled unit. Understandably, alignment of envelope 33 and particularly the filament structure 42 contained therein relative to the internal reflective surfaces 43 of reflector 13 such that filament structure 42 is precisely oriented (i.e., centered on) relative to the reflector's optical axis OA—OA and, equally important, the reflector's focal point FP, is deemed critical to assure optimum light output. Accordingly, it is essential that lamp 30 be initially precisely oriented relative to holder 19 in a fixed relationship therewith such that when the holder is finally positioned within opening 11 this critical alignment is attained. Such precisioned alignment constitutes an important feature of the instant invention, in addition to the provision of the aforementioned hermetic seal.

In FIG. 2, the lead-in wires 31 are shown projecting from envelope 33 into the first cavity 21 of holder 19. Positively secured (e.g., welded) to these wires in a predetermined manner are a plurality of rigid support wires 43, each being of L-shaped configuration and extending within (passing through) a corresponding one of the metallic eyelets 27. Each of these support wires is preferably of 0.080 inch diameter nickel-plated steel, although it is of course understood that other metals could be utilized. Attachment of each support wire 43 to a respective one of the conductive eyelets is achieved by soldering such that a quantity of solder 45 flow within the hollow eyelet and effectively surrounds the support wire centrally disposed therein. One example of a suitable solder for use in the invention is a 30/70 tin-lead composition. Other suitable compositions include a 60/40 tin-lead composition, and a 20/80 tin-lead composition. The solder, in addition to providing a sound electrical connection between the eyelet and support wire, also assures the defined hermeticity at this portion of the connection by virtue of its complete filling of the illustrated end portion of the eyelet. It also serves to rigidly maintain the support wire in a fixed position relative to holder 19 such that the corresponding lamp 30 will be maintained in the substantially fixed position shown. Positive positioning of the lamp is thus assured. It is understood that for purposes of the invention support wires 43 constitute extensions of the lead-in wires 31 to which they are attached. In effect, these members thus form part of the lead-in wire assembly. Accordingly, it is within the scope of this invention to provide lead-in wires 31 of greater length, subject these to various bending operations (to form the configurations depicted in FIG. 2), and insert the ends thereof within respective eyelets 27, thus eliminating the need for support wires 43 as defined herein. In such an arrangement, these lead-in wires would assure the necessary rigid support function required in the invention.

It should also be noted that only three support wires 43 are utilized to accommodate a total of four lead-in wires 31. This is so because one of the support wires is welded (and thus electrically joined) to two lead-in wires to serve as a common lead in the overall circuit.

To provide effective connection between the respective lug members 35 and corresponding conductive eyelets 27, a mechanical operation is utilized. Specifically, a projecting end segment of each of the metallic eyelets is crimped over the leg portion of the respective lug member which rests against wall 25. Because the eyelet includes a flange portion at the opposing end thereof (against an opposing surface of wall 25), this crimping operation in effect draws the eyelet positively within the corresponding conical-shaped aperture 20. The result, therefore, is that a seal is provided between each eyelet and corresponding aperture. The defined crimping operation, as stated, functions to provide the essential electrical connection between lug and eyelet components.

In accordance with the teachings of the instant invention, lamp unit 10 further includes a new and unique means for providing precisioned alignment of the lamp's envelope (and contained filament structure) within the holder member. More specifically, the invention provides a means for precisely orienting the lamp's envelope in at least three directions relative to the locating surfaces of the holder which align with and engage the reflector when the holder is in final position within the reflector. This three-way orientation prior to final securement of the lamp, including securement of the aforementioned lug and eyelet components, not only assures such precise alignment but, as explained below, is readily adaptable to mass production techniques.

Figure 3:
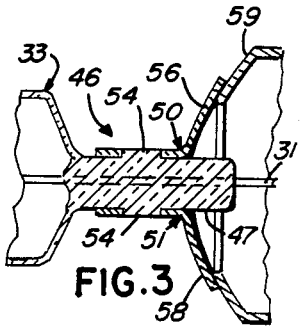
FIG. 3 is a partial, side elevational view on a larger scale of the clamp member and electric lamp of the invention, illustrating particularly the positioning relationship of the clamp member on the sealed end of the electric lamp.

To accomplish this, unit 10 includes a clamp member 46 which is secured about the press-sealed end portion 47 of envelope 33 at a precise location relative to the contained filament structure 42. In addition, unit 10 further includes an insert member 48 which is designed for occupying a predetermined, precise depth within cavity 21 of holder 19. Both member 48 and cavity 21 are of substantially cylindrical shape to facilitate such insertion. In addition, the clamp and insert members are both preferably comprised of steel (i.e., stainless steel), having a thickness of only about 0.016 inch. Clamp member 46 is of two-part construction, comprising two opposing, substantially similar side elements 50 and 51 which, in assembly, are each positioned against an opposing side of the relatively flat end portion 47 such that end tabs 52 thereof become aligned and contact each other. A weld is then performed to connect both opposing pairs (only one pair shown in FIG. 1) of tabs. Precise alignment of each side element is achieved by the provision of two upstanding segments 54 on each opposing side (only two shown in FIG. 1) of sealed end portion 47 and a corresponding number of similarly shaped openings 55 within each side element. Understandably, the upstanding segments, which align with and are inserted within these openings, are precisely located at the time of pressing end portion 47. As is known in the art, press-sealing of a tungsten-halogen lamp envelope typically occurs only after the lamp's filament structure has been inserted to a prescribed depth within the glass tubing which eventually forms the lamp's envelope. This positioning relationship is best illustrated in FIG. 3. It is thus seen that clamp member 46 is accurately located relative to the filament structure 42.

With clamp member 46 in place, the next step in assembling unit 10 involves partially inserting insert member 48 within cavity 21. When achieved, preferably in a vertical orientation (lamp 30 located upright), the lamp and clamp member assembly is lowered until flange portions 56 and 58 of said elements 50 and 52 respectively engage an outer surface 59 of insert member 48. Flange portions 56 and 58 and outer surface 59 are both of similar curvature (see especially FIG. 3) to facilitate this engagement and, particularly, to facilitate alignment therebetween. This curvature is preferably substantially spherical. Lamp 30 and clamp member 46 are then lowered, exerting a downward force on insert member 48, until member 48 occupies a precise depth within cavity 21. This is considered the first of the aforementioned three directions of orientation. Lamp 30 and clamp member 46 are then moved in a side-to-side direction ("A" in FIG. 2) until the filament structure is substantially centered. Simultaneously with this movement, the envelope 33 is rotated ("B" in FIG. 2) to precisely orient the coiled filament structure in this manner. At all times, the curved flange portions 56 and 58 maintain contact with outer surface 59. When proper orientation is achieved (i.e., as determined by camera inspection), flange portions 56 and 58 are welded to surface 59. Laser welders are preferably used because these devices can be accurately aimed and triggered from a distance, thus not interfering with outer components of the overall machine which provide assembly of the invention. Insert member 41, being metallic, is securedly positioned within the plastic holder 19 using RF induction heating. That is, member 41 is heated to the point that softening of the inner walls of the holder occurs with said material thereafter permanently adhering to the insert. Filament structure 42 has thus been precisely oriented within unit 10 relative to the aforementioned referencing surfaces of holder 19. During this orientation, the three support wires 43 were inserted within the respective eyelets 27 which in turn were only loosely positioned within their respective apertures 29. After all of the above precise aligning has occurred, including fixed securement (welding) of the clamp and insert members, the lug members 35 are then secured to the respective eyelets using a crimping operation. The defined solder 45 is then applied and a substantially assembled unit 10 is ready for insertion within reflector 13.

With further regard to the invention, it is understood that the side-to-side movement of envelope 33 can also include movement toward and away from the viewer in FIG. 2, or various alternative directions if desired, in place of or even in addition to that depicted by arrow "A". It is believed, however, that the extreme precision provided by the invention can be attained with only the three types of movement described above.

A significant feature of the instant invention is that not only has precisioned alignment been achieved in a highly expeditious manner but such alignment is achieved without the need for cement or the like. Curing time for this material would add appreciably to the overall assembly of such a unit. In addition, cements of this type typically outgas at elevated temperatures, such gas possibly adversely affecting the finished product (e.g., by affecting the internal reflective surfaces of the headlight's reflector. The lamp unit of the instant invention overcomes both of these deleterious occurrences.

As also shown in FIG. 2, reflector 13 includes a projecting neck portion 67 which extends from the rear portion of the reflector and is located about opening 11 (that is, opening 11 extends through the circumferential neck 67). Located within the exterior surfaces of neck portion 67 is at least one groove 71. To further assist in retaining holder 19 within opening 11, a removable cap member (not shown) is utilized. This cap is adapted for being positioned within (engaging) the corresponding groove 71 and can include a resilient base segment designed for engaging an external surface of holder 19. Such a base segment is preferably resilient to allow flexure thereof during engagement with the holder to prevent lamp misalignment as a result of said engagement. Positioning of holder 19 within reflector 13 is accomplished merely by aligning corresponding slots (not shown) within the external surface of the holder with corresponding male protuberances or the like (not shown) which are spacedly located about the reflector opening 11. Holder 19, having lamp 30 fixedly and precisely positioned therein in the manner defined above, is thus merely inserted within reflector 13 to the depth indicated in FIG. 2. There is thus no need for rotational-type movement of the holder in order to secure its final position within reflector 13. Thereafter, the aforedescribed cap member, preferably including a large central orifice adapted for passing over the exterior surfaces of the rear portion of holder 19, is simply screwed onto the upstanding neck portion 67 of reflector 13. Retention of this cap is preferably assured by provision of an upstanding flange on holder 19. A similar number of projecting segments (not shown) which form part of the cap are designed for passing through various recesses after which the cap is rotated a short distance to effect locking.

To further assure a sound hermetic seal between the exterior surfaces of holder 19 and the corresponding internal surface of opening 11, a rubber O-ring 82 is provided. As shown in FIG. 2, O-ring 82 is positioned within a corresponding groove or slot within the holder's external surface and projects slightly thereabove. Accordingly, a compression fit is provided between the outermost edge of the O-ring and the corresponding internal surfaces of holder 19.

There has thus been shown and described a replaceable lamp unit for use within an automobile headlight wherein the unit provides both a hermetic seal between the electric lamp used therein and the holder, in addition to an effective means of precisely aligning the lamp in fixed relationship to the holder. As shown in FIG. 2, an automobile headlight capable of using replaceable lamp unit 10 includes the concave reflector 13 and the corresponding front lens member 41 which may be sealed to the reflector in any manner known in the art. It is also within the scope of the invention to utilize a reflector and lens which constitute an integral unit, thus eliminating the need for a seal therebetween. Suitable materials for the reflector and lens are glass and plastic (e.g., polycarbonate). With lamp unit 10 in position within reflector 13, the filament structure of the electric lamp used therein is precisely oriented relative to the reflective surfaces of the reflector, and the focal point and optical axis thereof. Should the lamp fail (burn out), replacement is readily achieved by removing the external connector and retaining cap member, withdrawing the holder and contained lamp, and thereafter directly inserting a new holder-lamp assembly. The retaining cap and external connector are then located in place.

While there have been shown and described what are at present considered the preferred embodiments of the invention, it will be obvious to those skilled in the art that various changes and modifications may be made therein without departing from the scope of the invention as defined by the appended claims.

What is claimed is:

1. In a lamp unit for being removably positioned within an opening within the rear portion of an automobile headlight reflector wherein said lamp unit includes an electrically insulative holder for being positioned within said opening and defining a cavity therein and an electric lamp adapted for being positioned within said holder, said lamp including an envelope having a filament structure therein and at least two lead-in wires projecting from said envelope, said filament structure being oriented within said reflector of said automobile headlight when said holder is positioned within said opening, the improvement comprising:

a clamp member secured about said envelope of said electric lamp at a precise location relative to said filament structure; and an insert member located at a predetermined, precise depth within said cavity of said insulative holder, said clamp member being aligned on a surface of said insert member and secured thereto such that said filament structure will be oriented within said reflector in a precise manner relative thereto when said insulative holder is positioned within said reflector opening.

2. The improvement according to claim 1 wherein said clamp member is of two-part construction and said envelope of said electric lamp includes a pressed end portion, said clamp member being secured about said end portion.

3. The improvement according to claim 2 wherein each of said two parts are located about said pressed end portion and thereafter secured to each other.

4. The improvement according to claim 2 wherein said pressed end of said envelope includes at least one upstanding segment thereon and said clamp member includes at least one opening therein, said upstanding segment being located within said opening to thereby assist in orienting said clamp member at said precise location relative to said filament structure.

5. The improvement according to claim 4 wherein the number of said upstanding segments and said openings is four, said segments being arranged in pairs of two on opposing sides of said pressed end portion of said envelope.

6. The improvement according to claim 2 wherein said clamp member includes at least one flange portion, said flange portion being aligned on said surface of said insert and secured thereto.

7. The improvement according to claim 6 wherein said surface of said insert and said flange portion of said clamp member are of substantially the same curvature to facilitate said alignment of said flange portion.

8. The improvement according to claim 6 wherein the number of said flange portions is two.

9. In an automobile headlight including a concave reflector having an opening within the rear portion thereof, a front lens member for directing light from said headlight in a predetermined manner, and a lamp unit for being removably positioned within said opening of said reflector, said lamp unit including an electrically insulative holder for being positioned within said opening and defining a cavity therein and an electric lamp adapted for being positioned within said holder, said lamp including an envelope having a filament structure therein and at least two lead-in wires projecting from said envelope, said filament structure being oriented within said reflector of said automobile headlight when said holder is positioned within said opening, the improvement comprising:

a clamp member secured about said envelope of said electric lamp at a precise location relative to said filament structure; and an insert member located at a predetermined, precise depth within said cavity of said insulative holder, said clamp member being aligned on a surface of said insert member and secured thereto such that said filament structure will be oriented within said reflector in a precise manner relative thereto when said insulative holder is positioned within said reflector opening.

10. The improvement according to claim 9 wherein said clamp member is of two-part construction and said envelope of said electric lamp includes a pressed end portion, said clamp member being secured about said end portion.

11. The improvement according to claim 10 wherein each of said two parts are located about said pressed end portion and thereafter secured to each other.

12. The improvement according to claim 10 wherein said pressed end of said envelope includes at least one upstanding segment thereon and said clamp member includes at least one opening therein, said upstanding segment being located within said opening to thereby assist in orienting said clamp member at said precise location relative to said filament structure.

13. The improvement according to claim 12 wherein the number of said upstanding segments and said openings in four, said segments being arranged in pairs of two on opposing sides of said pressed end portion of said envelope.

14. The improvement according to claim 10 wherein said clamp member includes at least one flange portion, said flange portion being aligned on said surface of said insert and secured thereto.

15. The improvement according to claim 14 wherein said surface of said insert and said flange portion of said clamp member are of substantially the same curvature to facilitate said alignment of said flange portion.

16. The improvement according to claim 14 wherein the number of said flange portions is two.

* * * * *